United States Patent [19]

Dreyer et al.

[11] Patent Number: 4,752,987

[45] Date of Patent: Jun. 28, 1988

[54] SUPPORT AND GUIDE SYSTEM FOR MOVABLE DOOR OR WALL ELEMENTS

[75] Inventors: Fredo Dreyer, Edewecht; Bernd J. Kappe; Karl Schüsler, both of Oldenburg, all of Fed. Rep. of Germany

[73] Assignee: Huppe GmbH, Fed. Rep. of Germany

[21] Appl. No.: 871,078

[22] Filed: Jun. 5, 1986

[30] Foreign Application Priority Data

Jun. 26, 1985 [DE] Fed. Rep. of Germany ..... 3522824

[51] Int. Cl.[4] ..... E05D 13/02

[52] U.S. Cl. ..... 16/102; 16/106; 104/94; 104/96

[58] Field of Search ..... 16/89, 97, 98, 102, 16/106; 104/94, 96, 105

[56] References Cited

U.S. PATENT DOCUMENTS

| | | | |
|---|---|---|---|
| 1,097,661 | 5/1914 | Mohler | 16/106 |
| 2,943,579 | 7/1960 | Bel Geddes | 104/94 |
| 3,462,792 | 8/1969 | Greco | 104/94 |
| 3,830,165 | 8/1974 | Turner | 104/94 |
| 3,879,799 | 4/1975 | Williams | 16/106 |
| 3,880,086 | 4/1975 | Khondker | 104/94 |
| 4,122,778 | 10/1978 | Di Rosa | 104/94 |
| 4,555,828 | 12/1985 | Matimura | 16/102 |

FOREIGN PATENT DOCUMENTS 2129283 1/1973 Fed. Rep. of Germany .

OTHER PUBLICATIONS

Huppe VeriFlex Catalog.

*Primary Examiner*—Kurt Rowan
*Attorney, Agent, or Firm*—Wood, Herron & Evans

[57] ABSTRACT

A support and guide system for movable door or wall elements is disclosed, which system comprises stationary ceiling channels with channel junctions. Running in the ceiling channels are trolleys from which the door or wall elements are suspended through a gap in the ceiling channel. The trolleys feature trolley rolls which are rotatable about horizontal axles which are located on the side edges of a square. Provided in the areas of the channel junctions are additional support elements, in the ceiling channels, for trolley support. To enable a material- and weight-saving design, the support elements are inserted in the ceiling channels, on support arms, at a specified spacing above the trolley, while above the trolley there is a support plate mounted which is supportable from underneath by the support elements.

7 Claims, 2 Drawing Sheets

SUPPORT AND GUIDE SYSTEM FOR MOVABLE DOOR OR WALL ELEMENTS

Figure 1:
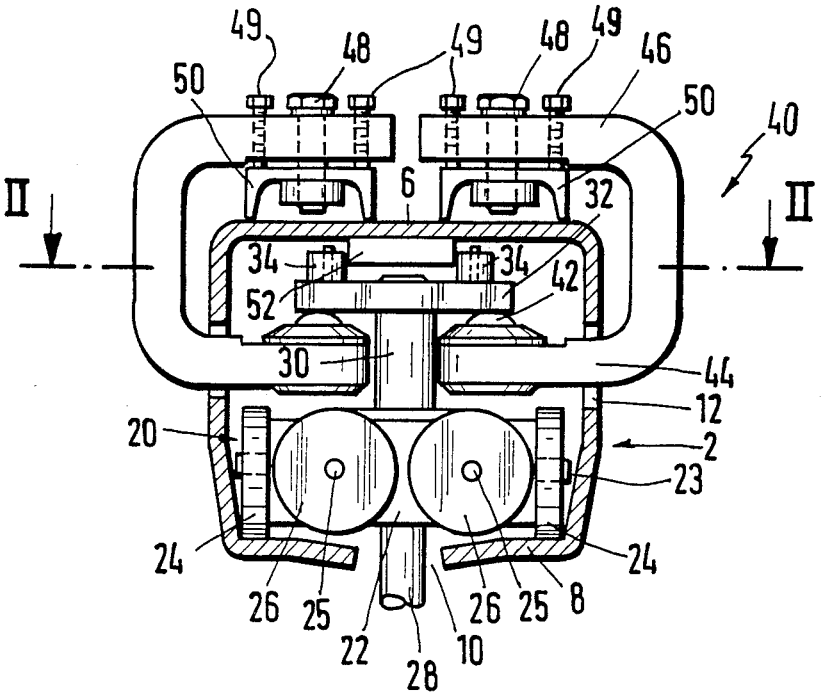

The invention concerns a support and guide system for movable door or wall elements, consisting of stationary ceiling channels with channel junctions, trolleys in the ceiling channels on which the door or wall elements are mounted passing through a gap in the ceiling channel, with the rollers of the trolleys comprising horizontal axles and being arranged on the trolley so as to bear on the side edges of a square and to roll on horizontal running surfaces of the ceiling channels, and with support elements in the ceiling channels in the area of the channel junctions, for additional support of the trolleys.

Such a support and guide system has been known for some time, compare the brochure "Huppe Variflex" of the firm Huppe GbmH. In this prior system, the support elements which in the area of the channel junctions are to lend additional support to the trolley are recessed in the horizontal running surfaces of the ceiling channels and make direct supporting contact with the bottom side of the trolley body, while the rollers pass in the area of a channel junction across a transverse gap of a branching ceiling channel. The installation of the support elements normally requiring an installation space also below the running surfaces, the ceiling channels comprise at a given spacing, below the running surfaces, horizontal cover flanges which must extend across the entire length of the ceiling channels to enable a continuous tight contact of the horizontal, extendable upper ceiling strips of the wall elements. But these continuous cover flanges, especially with large and heavy systems where the ceiling channel must have an appropriately large cross section and consist of steel or similar materials, prove to be expensive and disadvantageous because the material expense and the weight of the ceiling channels are considerably increased.

Previously known from the German patent disclosure No. 21 29 283 is a support and guide system for movable door or wall elements where the rollers of the trolleys have vertical axles and conic running surfaces rolling on correspondingly inclined vertical running surfaces of the ceiling channels. Provided in the area of the channel junctions, in the ceiling channels, are a swell support elements which are arranged on horizontal lower cover flanges and make supporting contact on the bottom side of the trolley body. The danger with this prior arrangement, especially in case of a greater weight of the door or wall elements, is that the conic rollers will wedge on the inclined running surfaces causing the trolleys to bind. Since the inclined running surfaces, in the area of the channel junctions, are interrupted across the entire width of a ceiling channel—and not only across the width of the channel gap—the trolley guidance is not always satisfactory at these junction points, since the support elements represent the only guide organs across this relatively long running distance.

The problem underlying the invention is to advance a support and guide system of the initially named type in a fashion such that the ceiling channels will have a design which saves material and weight while likewise enabling a reliable support and guidance of the trolleys in the area of the channel junctions.

This problem is inventionally solved in that the support elements are at a predetermined distance above the trolleys inserted in the ceiling channels, on support arms, acting from below on a support plate which is mounted on the trolley.

The advantages of the invention specifically are that the channel flanges supporting the running surfaces close the ceiling channels on the bottom side, and that the support elements are inserted, locally in the area of the channel junctions, on support arms in the interior of the ceiling channel, contacting from below a support plate mounted on the trolley, as the trolley passes, thereby supporting it. The additional lower cover flanges for covering the support elements and forming a contact surface for ceiling strips can be eliminated as well. Sufficient for mounting the support elements are locally arranged support arms which, in channel direction, have only comparatively small dimensions. The elimination of additional cover flanges saves material; the accompanying weight reduction of the ceiling channels, specifically in case of large and thus heavy door and wall elements, is considerable.

The support arms extend preferably through side openings into the interior of the ceiling channels and are provided on their inner free end with the support elements while their outer end is fastened on the ceiling channels. Provided between the support arms and the ceiling channel are preferably adjustment means permitting a positional adjustment of the support elements. This makes it possible to accomplish that the support elements which in the area of the channel junctions are arranged on various separate support arms will all be on the same level so that the support plate—and thus the trolley—cannot tilt or cant as it runs on the support elements.

Following the adjustment, the support arms can be permanently welded to the ceiling channel or nondetachably connected in some other way.

Employed as support elements are preferably balls which can rotate in all directions, while races are formed, in running direction, in the underside of the support plate and above the support elements so as to guarantee a straight-line motion of the trolleys in the channel junction areas. Alternatively, sliding elements or pneumatic or magnetic bearing agents, respectively, can be employed as well as support elements.

To further aid the straight-line motion in the area of the channel junctions, guiding agents can be used on the ceiling channels, above the support plate, which interact with vertically mounted head rolls on the support plate.

Favorable advancements of the invention are characterized by the features of the subclaims.

An embodiment of the invention will be more fully explained hereafter with the aid of the drawing.

Figure 2:
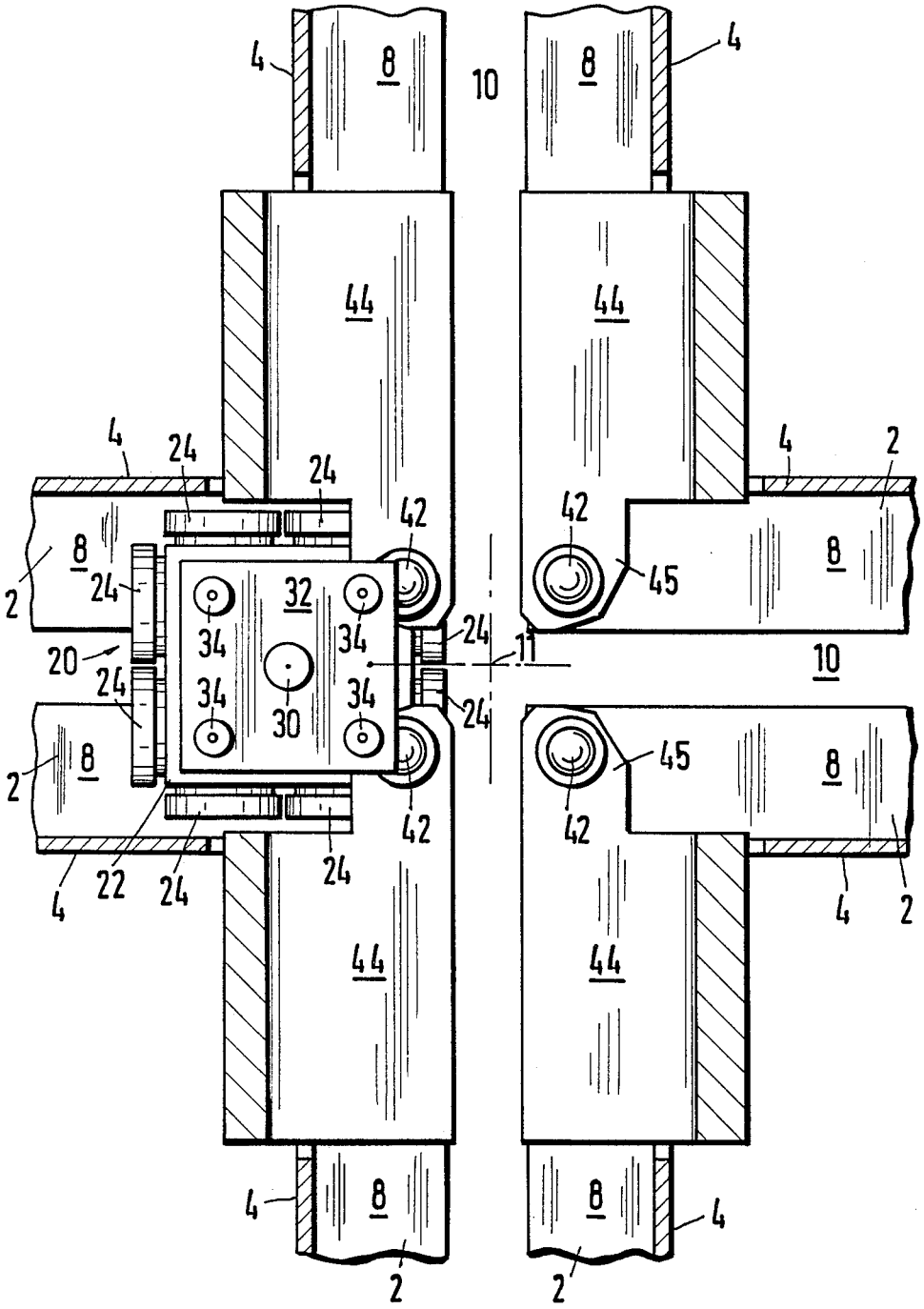

FIG. 1 shows a cross section of the support and guide system; FIG. 2, a section along line II—II relative to FIG. 1, presented at a channel crossing.

Presented in FIGS. 1 and 2 is a cross section and a plan view of a specific channel junction, namely a channel crossing. The ceiling channels 2 of the support and guide system have a box profile with an upper base 6 which sideways extends into parallel sidewalls 4 which extend downward. Bordering on the bottom end of the sidewalls 4 are running surfaces 8 which are directed at each other and form between themselves a gap 10 in the axial direction of the ceiling channel 2.

A door or wall element is usually mounted in hanging fashion, with the aid of a support bolt 28, on the trolley marked 20 in its entirety. The trolley 20 consists of a support body 22 having, in plan view, a quadratic shape; compare FIG. 2. Rotatably mounted on the side edges of the support body 22, on the same level, are two trolley rolls 24, 26 each on horizontal axles 23, 25. As shown in FIG. 1, parallel trolley roll pairs, for instance 24, run on essentially horizontal running surfaces 8 of the ceiling channels 2, whereas the trolley rolls 26 which then are located on the front or back end, respectively, are not engaged.

The support bolt 28 is mounted centrally on the support body 22 and extends through the gap 10 in the ceiling channel 2 downward. One door or wall element each is attached to the support bolts 28 of two spaced trolleys 20 and movable in the ceiling channel.

Presented in FIG. 2 is a right-angle intersection of two ceiling channels 2, in a plan view corresponding to the line II—II in FIG. 1. On this inside crossing, the gap 10 of the one ceiling channel is interrupted by the transverse gap 10 of the other ceiling channel. The illustrated trolley 20 runs—in the direction of the arrow, on its trolley rolls 24 into the crossing area, with the trolley rolls 24 bearing, and is located in the center of the crossing area as soon as the front trolley pair 24 has passed the gap 10 of the transverse ceiling channel 2 and the support bolt 28 is located in the intersecting point of the gap axes. If the trolley motion continues in the same direction, the rear trolley rolls 24 will subsequently cross the transverse gap 10, whereafter all trolley rolls 24 roll on the running surfaces 8 of the following equidirectional channel section. But if the direction of the trolley 20 is to be changed by 90° in the crossing area, the trolley is shifted in the desired direction, upon reaching the center of the crossing, whereafter the trolley rolls 24 engage the running surfaces 8 of the transverse ceiling channel 2, whereas the trolley rolls 26 are disengaged, since the running surfaces 8 are bent, toward the gap 10, slightly downward.

As a trolley passes through a junction area, in the case of the figure a crossing area, the support elements 42 assume the trolley 20 support in such a way that the trolley continues to move at an unchanged level across the crossing area, so that the previously and subsequently active trolley rolls 24 or 26, respectively, will not follow the running surfaces 8 which are bent down, but rather will become disengaged as regards the running surfaces 8.

Since the trolley rolls 24, 26 thus briefly leave the running surfaces 8 in the crossing area, it is necessary to ensure that thereafter they will make contact again with the running surfaces 8, without canting, as the trolley 20 continues to be moved either in its previous direction or, perpendicularly to it, into the branching ceiling channel 2. For the vertical support, compare specifically FIG. 2, the support elements 42 are arranged on the free ends 44 on support arms 40 which protrude into the crossing area of the ceiling channels 2. As follows from FIGS. 1 and 2, one support arm 40 each is arranged in each of the corners of the crossing ceiling channels 2, and the free ends 44 of the support arms 40 have a tongue 45 extending into the junction area and fixing the support elements 42 near the center 11 of the junction area.

The free ends 44 of the support arms 40 protrude through side openings 12 into the interior of the ceiling channels 2 and are mounted on the ceiling channel 2 with their outer end 46 bent over in the fashion of a U. As follows specifically from FIG. 1, the outer ends 46 of the support arms 40 are screwed, by means of screws 48 to the mounting yokes 50 which are permanently connected with the ceiling channel 2. Adjustment means of any conventional type, such as abutment screws 49 or shims can be provided between the support arms 40 and the mounting yokes 50 for adjusting the support arm position and thus the level of the support elements 42. These adjustment agents should enable an accurate height adjustment of the support arms 40 relative to the ceiling channel 2.

At a specified distance above the support body 22 of the trolley 20, a support plate 32 is arranged by means of a stud 30, which support plate has about the size of the support body 22 and extends parallel to it. The stud 30 protrudes between the two free ends 44 of the support arms 40, upward toward the base 6 of the ceiling channel. The height of the study 30 is so dimensioned that the bottom edge of the support plate 32 is horizontally flush with the upper edge of the support elements 42, so that the support plate as the trolley approaches the junction area—will be supported from below by the support elements 42, so that the trolley rolls 24, 26 will in the crossing area disengage the outwardly flared running surfaces 8 and set down on the running surfaces 8 again only behind the junction area.

Mounted on the support plate 32 of the trolley 20, in the illustrated embodiment, are head rollers 34 on vertical axles 33, which interact with guide facilities 52 which in the junction area are mounted on the base 6 of the ceiling channel 2 so as to accomplish in the junction area a better straight-line motion of the trolley. The guide agents consist, e.g., of plastic plates featuring transverse grooves at the necessary points so that the head rollers 34, in case of change of direction of the trolley, will encounter the necessary guideways in the guiding agents 52.

The support elements 42 consist of balls which in the tongues 45 of the support arms 40 are mounted in a fashion rotatable in all directions.

Especially preferred is connecting with the support and guide system a signaling device comprising in the areas of the channel junctions of a sensor each which can be operated or activated by trolley-fixed contact elements as the trolley reaches the central position in the junction area, out of which a directional change of the respective trolley is possible.

When activated, the sensor transmits an, e.g., electrical signal to a signaling device which subsequently indicates to the user, for instance optically or acoustically, that the directional change of the respective trolley and the door or wall element suspended from it can now be initiated.

Having described my invention, what I desire to claim by Letters Patent is:

1. Support and guide system for movable door or wall elements, consisting of stationary ceiling channels with channel junctions, trolleys in the ceiling channels on which the door or wall elements are mounted passing through a gap in the ceiling channel, the trolley rollers having horizontal axles and being arranged on the trolley, lying on the side edges of a square and rolling on the running surfaces of the ceiling channels, and with support elements in the ceiling channels in the area of the channel junctions for additional trolley support, characterized in that the support elements are inserted in the ceiling channel at a given spacing above the trolley, on support arms, acting from below on a support plate which is mounted on the trolley.

2. Support and guide system according to claim 1, characterized in that the support arms extend through side openings into the ceiling channel, support on their free inner end the support elements, and are mounted with their outer end on the ceiling channel.

3. Support and guide system according to claim 2, characterized in that between the support arm and the ceiling channel there are adjustment means provided for adjusting the height of the support elements.

4. Support and guide system of claim 3 in which the support arms, after their adjustment, are welded to the ceiling channel.

5. Support and guide system of claim 1 in which head rollers are mounted on vertical axles on the carrier plate of the trolley, and in that guide facilities interacting with the head rollers are mounted, in the junction areas, on the ceiling channels.

6. Support and guide system of claim 1 in which the support elements are balls rotatable in all directions.

7. Support and guide system according to claim 6, characterized in that in the bottom side of the support plate and above the support elements there are braces formed in running direction, for a straight-line motion of the trolleys.

* * * * *